United States Patent [19]

Boliver

[11] 3,955,874

[45] May 11, 1976

[54] SHIELDED POWER CABLE SEPARABLE CONNECTOR MODULE HAVING A CONDUCTIVELY COATED INSULATING ROD FOLLOWER

[75] Inventor: Vincent J. Boliver, Pittsfield, Mass.

[73] Assignee: General Electric Company, N.Y.

[22] Filed: Oct. 29, 1974

[21] Appl. No.: 518,179

[52] U.S. Cl. ..... 339/111; 174/37; 200/51 R; 339/143 R; 339/DIG. 3

[51] Int. Cl.[2] ..... H01R 13/52

[58] Field of Search ..... 339/111, DIG. 3, 143 R, 339/101; 200/51 R, 149; 174/37, 152

[56] References Cited

UNITED STATES PATENTS 3,322,885 5/1967 May et al. ..... 339/DIG. 3

3,539,972 11/1970 Ruete et al. ..... 339/111

*Primary Examiner*—Roy Lake
*Assistant Examiner*—DeWalden W. Jones
*Attorney, Agent, or Firm*—Volker R. Ulbrich

[57] ABSTRACT

A separable connector module for connecting shielded electrical power cable. It is of the type including an insulating housing containing a cable insert member. A male contact rod assembly, including a metal contact rod, is fixed at one end to the insert member. An insulating arc follower is fixed to the rod at its other end. An insulating mounting pin extends from the end of the rod and along at least a portion of the interior of the follower. The improvement comprises an electrically conducting coating on the mounting pin and in electrical contact with the rod.

7 Claims, 4 Drawing Figures

SHIELDED POWER CABLE SEPARABLE CONNECTOR MODULE HAVING A CONDUCTIVELY COATED INSULATING ROD FOLLOWER

BACKGROUND OF THE INVENTION

The present invention relates generally to electrical cable connectors and relates particularly, but not exclusively, to separable connector modules for connecting together the operating components of an underground power distribution system by means of shielded electrical cable.

Separable connector assemblies for underground power distribution cable, or shielded cable, are watertight when assembled and may be readily separated into two or more units to break a cable connection. As such units are available separately commercially for various reasons and are individually subject to special design considerations, they are commonly referred to as "modules". Thus, a connection includes two or more matching modules assembled together.

One type of separable connector commonly used is known as a "rod and bore" type. A bore connector module having a receiving bore in a shielded, insulating housing and a grasping contact member in the bore receives a matching rod connector module having rod contact which is inserted in the bore and grasped by the bore contact member. Examples of this type of connector are described, for example, in the following U.S. Patents:

- U.S. Pat. No. 3,513,437 issued 19 May 1970 to W. A. Morris
- U.S. Pat. No. 3,542,986 issued 24 Nov. 1970 to E. J. Kotski
- U.S. Pat. No. 3,551,587 issued 29 Dec. 1970 to R. F. Propst, and
- U.S. Pat. No. 3,587,035 issued 22 June 1971 to E. J. Kotski.

It is desirable to be able to operate such connectors while their cables are electrically active to interrupt the power. As the cables are generally carrying power at a voltage on the order of thousands of volts, separation of the contacts of the connector on a live cable results in the formation of an electric arc between the contacts. The arc will, unless promptly extinguished, eventually strike a ground plane such as the grounded shielding of the modules, and create a direct line-to-ground fault.

In present connectors, the bore is lined with ablative material and the rod is provided with an ablative arc follower of ablative material, a material which generates arc-extinguishing gases when subjected to an electric arc. The arc follower of the rod is a rod-shaped extension at the end of the metal contact rod and is generally somewhat smaller in diameter than the rod. When the contact rod is pulled from the contact member of the bore module, the resulting arcing passes between the follower and the bore lining. The exposure of the ablative material to arcing causes it to generate arc-extinguishing gases which rapidly extinguish the arc. This permits the connector to be utilized as a switch by being operated under live conditions, without creating a line-to-ground fault.

There is generally provided in the end of the contact rod a short, smaller diameter metal mounting pin which extends along the interior of the follower, either to provide a means for mounting the follower on the rod or to lend additional rigidity to the ablative material of the follower, if required. The pin cannot, however, extend the full length of the follower, as this would shunt the follower and defeat its function. Therefore, the pin terminates a short distance, about one cm (centimeter), from the follower end for insulation from the receiving contact. One problem with the above-described rod structure has been breakage of the follower tip, that portion of the follower extending beyond the end of the mounting pin. Such breakage can result in an arc from the mounting pin to the receiving contact, with resultant failure to interrupt the current.

A prior approach to the above problem has been the use of an insulating mounting pin which may extend the full length of the follower. Typically, such a pin is made of glass fibers bundled together in a resin binder. While such a structure does prevent breakage of the follower tip, it has been found that such a structure is more susceptible to failure at higher voltages than is the metal pin structure.

SUMMARY OF THE INVENTION

The novel connector module comprises a contact rod arc follower mounting pin of insulating material which is provided with a conductive coating electrically connected to the contact rod.

The coating improves the electrical characteristics of the contact rod, so that the failure rate at the higher voltages is reduced.

DESCRIPTION OF THE PREFERRED EMBODIMENT

Figure 1:
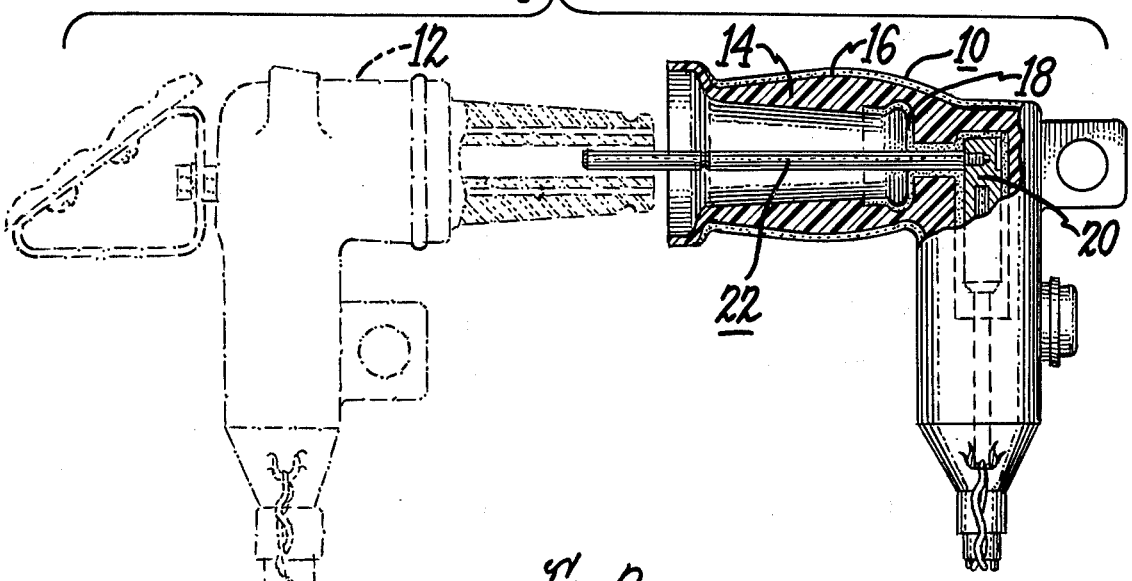
FIG. 1 is a partially sectioned side view of a matching pair of separable connector elbow modules, of which the bore connector module is shown in phantom lines and the rod connector elbow module is shown in solid lines and in accordance with the preferred embodiment of the present invention.

A preferred embodiment of the present invention is the rod connector elbow module 10 shown in FIG. 1 of the drawings. The elbow 10 is shown together with a matching bore connector elbow module 12 drawn in phantom lines to illustrate the manner in which the two elbow modules 10, 12 are assembled together to complete a cable connector.

The rod elbow 10 includes an insulating housing 14 of elastomer having an outer covering of resilient conductive shielding 16 and an inner recess which is lines with conductive resilient voltage grading material 18. Closely fit inside the recess is a threaded cable insert member 20, which provides a support for, and to which is secured a contact rod assembly 22, shown separately and in more detail in FIG. 2.

Figure 2:
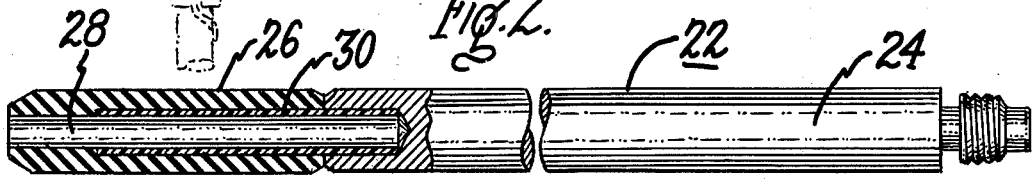
FIG. 2 is a partially sectioned side view of the contact rod assembly of the rod elbow of FIG. 1.

Referring now to FIG. 2, the rod assembly 22 consists of a round copper contact rod 24 about 11 cm long and 1.2 cm in diameter provided at one end with threads for attachment to the cable insert member 20. Attached to the other end of the contact rod 24 is a hollow, rod-shaped arc follower 26 about 5 cm long and substantially the same diameter as is the rod 24. The follower 26 is of ablative material, such as, for example, a cycloaliphatic epoxy resin which may be filled with hydrated alumina. Extending the entire length of the follower 26 inside its hollow portion is a mounting pin 28, about 6.2 cm long and 0.6 cm in diameter, of aligned glass fibers bonded together with epoxy resin. The outside of the pin 28 is coated along about 5.2 cm of its length by a 0.01 mm (millimeter) thick conductive coating 30 of carbon black dispersed in a binder of polyurethane. The coating 30 is applied by dipping the pin 28 in a solution of polyurethane in toluene, in which solution the carbon is dispersed, and then drying.

The mounting pin 28 is fastened to the rod 24 by insertion of the coated end in a blind hole in the unthreaded end of the rod 24 and crimping of the end of the rod 24 around the pin 28. The coating 30 thereby makes electrical contact to the rod 24. The follower 26 is then molded over the pin 28.

The coating 30 on the pin 28 acts to establish an improved distribution of electrical field lines about that portion of the contact rod assembly 22 where the follower 26 joins the contact rod 24. This improves the performance of the follower 26, and hence the connector elbow 10.

The novel connector provides the desirable reinforcement of the follower 26 along its full length to prevent breakage of the tip, while at the same time preserving essentially the same electrical field characteristics as in the prior structure having a metal mounting pin with its end spaced from the follower tip. Thus with the novel connector, tip breakage is eliminated without the disadvantage of degraded performance at higher voltage levels.

GENERAL CONSIDERATIONS

While the various phenomena involved in the operation of separable connectors are presently not completely understood, it is believed that the increased failure rate which results when the metal mounting pin of the follower is replaced by an insulating mounting pin is due to overstressing of the follower material in that portion of the follower adjacent the end of the rod. The voltage stress in the general vicinity of this portion of the follower is roughly illustrated in the FIG. 3 of the drawings.

Figure 3:
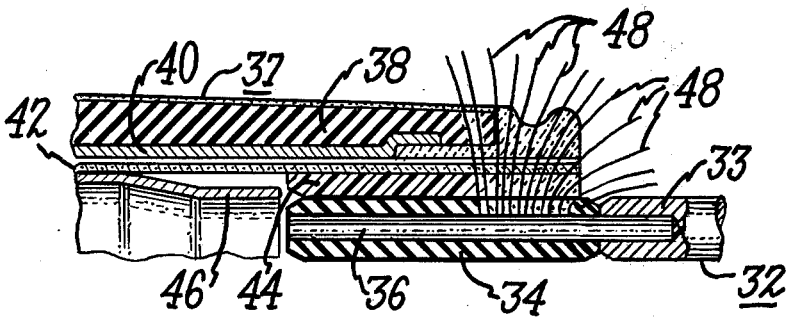
FIG. 3 is a partially sectioned side view of a prior art connector showing in exaggerated form the approximate configuration of equipotential lines about the portion of the follower adjacent the rod of the contact rod assembly.

The FIG. 3 shows a rod assembly 32 including a rod 33, a follower 34, and an insulating mounting pin 36. The pin 36, in accordance with the prior art, is without a conductive coating. The rod is shown inserted in the receiving bore of a matching bore connector module 37. Only a portion of the bore module is shown, and on only one side of the rod assembly, as it is apparent that the structure on the opposite side is symmetrical about the axis of the rod and bore.

The bore module includes an insulating housing 38 which has an inner metal shield member 40 and a removable bore sleeve 42. On the inside of the bore sleeve 42 is a liner 44 of ablative material. A set of metal bore contact fingers 46, of which one is shown, is mounted in the sleeve 42.

The follower 34 is shown with its end just approaching the bore contact fingers 46, this being a rather critical physical relationship in the operation of the connector. The general configuration of the voltage stress is shown in somewhat exaggerated form by the equipotential lines 48. It can be seen from these lines 48 that there is a strong voltage gradient along the surface of the follower 34 immediately adjacent the end of the rod 33. The strong gradient can cause progressive local dielectric breakdown of the follower 34 surface material or otherwise impair the function of the follower 34 by, for instance, permitting premature arcing on closing or extended arcing on opening of the connection.

Figure 4:
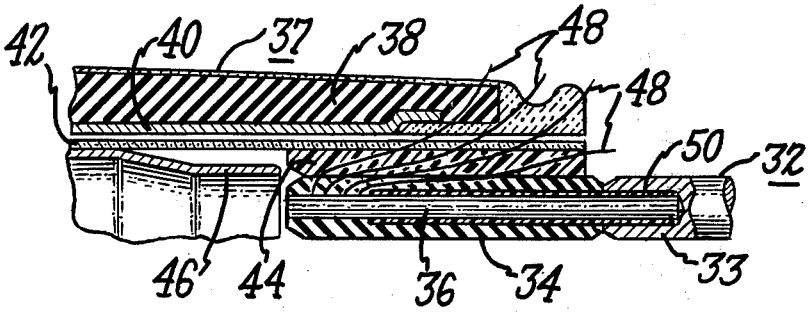
FIG. 4 is a partially sectioned side view of a connector generally similar to that of FIG. 3, but including in addition a conductive coating in accordance with the present invention and showing in exaggerated form the approximate configuration of equipotential lines about that portion of the follower adjacent the rod of the contact rod assembly.

The change in field distribution resulting from the addition of a conductive coating 50 to the pin 36 of the above rod 33 in accordance with the present invention is illustrated in FIG. 4. The structure is otherwise the same as that of FIG. 3, and the same reference numerals are used. The field lines 48 can now be seen to indicate a greatly reduced stress on the follower 34 adjacent the rod 33 with the result that surface breakdown of the follower material there is avoided and the function of the follower 34 is improved.

As is illustrated by the preferred embodiment, the insulating housing of the connector is not necessarily entirely of insulating material, but rather has the function of insulating the current conducting structure of the module, attached to the cable, from nearby structures which are at a different voltage. Certain shielding and voltage grading structures may be included as part of the housing in order to best perform this function.

While the mounting pin of the preferred embodiment extends the full length of the follower, the pin need not extend to any particular length to be within the spirit of the present invention. Although the extending of the pin along the full length is advantageous to prevent tip breakage for the type of follower material of the preferred embodiment, the pin need only be extended sufficiently to provide the necessary reinforcing for the particular follower material used.

The coating on the mounting pin need not be highly conductive, since no appreciable current is carried by it and its actual value is not critical. It need only to be substantially more conductive along its length than the insulating follower itself to provide the improved field distribution. As a practical matter, the coating may have a resistance per unit length as high as about one-hundredth the resistance per unit length of the follower portion. A number of other materials may be used for the conductive coating. The choice of such other materials will be readily apparent to those skilled in the art of conductive coatings.

While improved distribution of the field results when the coating extends even a short distance along the mounting, it is desirable to extend the coating as far as possible, provided its end is spaced far enough from the end of the follower that it is sufficiently insulated from that end to prevent breakdown of the tip of the follower for the voltage level involved. Adequate spacing is generally between one and two centimeters.

The term "coating" as used herein with regard to the conductive coating on the mounting pin is meant as being synonymous with "covering" and "layer". The thickness of the coating is not particularly critical, so long as it is not so thick as to leave no place for the surrounding follower material. Thus the coating could be provided, for instance, by fitting a conductive sleeve about the pin prior to assembly of the pin to the rod. The sleeve might be of metal or even a shrinkable tubing of conductive polymer.

While the present invention has thus far been described mainly as it relates to a separable connector for shielded power cable, its usefulness if not limited to that type of connector. Rod and bore contacts pairs may be used for a variety of other apparatus for connecting and disconnecting electrical power. Rod and bore contacts may be used for example, in a loadbreak fuse, a circuit breaker switch, and other switches in which arcing presents a serious problem. In any such apparatus it may be desirable for reasons of cost or structural properties to provide the rod contact with an arc follower having an insulating mounting pin conductively coated.

I claim:

1. A rod connector module for separably connecting shielded electrical power cable, comprising:

an insulating housing containing a contact rod support;

a contact rod assembly, including a metal contact rod to be received by a bore contact, said rod being fixed at one end to said support;

an insulating arc follower fixed to said rod at its other end for insertion into the bore, and an insulating mounting pin extending from the end of said rod along at least a portion of the interior of said follower, wherein the improvement comprises, an electrically conductive coating on said pin and in electrical contact with said rod.

2. The module of claim 1 wherein said pin is a bundle of glass fibers bonded together with a resin.

3. The module of claim 2 wherein said pin extends substantially to the free end of said follower.

4. The module of claim 3 wherein said coating extends along a major portion of the length of said pin and begins where said pin is joined to said rod.

5. The module of claim 4 wherein said coating has a resistance per unit length of about 1/100 times the resistance per unit length of the adjacent follower material, or less.

6. The module of claim 5 wherein said coating consists essentially of carbon particles bonded by polyurethane.

7. The module of claim 1 wherein:

said pin is a bundle of glass fibers bonded together by epoxy resin and clamped at one end inside an opening in the end of said rod;

said coating extends from the clamped end of said pin to within between one and two centimeters of its end and consists essentially of carbon particles bonded by polyurethane;

said follower is an ablative resin composition and extends as far from the end of said rod as does said pin, and said housing is a shielded, molded elastomer elbow housing having an elongated entrance opening for receiving a matching portion of a bore connector module, said contact rod being located coaxially in said opening.

* * * * *

UNITED STATES PATENT OFFICE

CERTIFICATE OF CORRECTION

PATENT NO. : 3,955,874

DATED : May 11, 1976

INVENTOR(S) : Vincent J. Boliver

It is certified that error appears in the above-identified patent and that said Letters Patent are hereby corrected as shown below:

In the title after "FOLLOWER" insert -- MOUNTING PIN -- .

Signed and Sealed this

Third Day of August 1976

[SEAL]

*Attest:*

RUTH C. MASON
*Attesting Officer*

C. MARSHALL DANN
*Commissioner of Patents and Trademarks*